United States Patent [19]

Brown et al.

[11] Patent Number: 4,885,080

[45] Date of Patent: Dec. 5, 1989

[54] PROCESS FOR DEMETALLIZING AND DESULFURIZING HEAVY CRUDE OIL

[75] Inventors: Ronald E. Brown; Robert J. Hogan, both of Bartlesville, Okla.; Daniel M. Coombs, Borger, Tex.; Simon G. Kukes, Naperville, Ill.

[73] Assignee: Phillips Petroleum Company, Bartlesville, Okla.

[21] Appl. No.: 198,767

[22] Filed: May 25, 1988

[51] Int. Cl.[4] ..... C10G 31/00

[52] U.S. Cl. ..... 208/218; 208/211; 208/251 H; 208/303; 208/254 H; 208/221; 208/80; 208/93

[58] Field of Search ..... 208/218, 211, 251 H, 208/303, 254 H, 80, 93

[56] References Cited

U.S. PATENT DOCUMENTS

| | | | |
|---|---|---|---|
| 2,938,857 | 5/1960 | Johnson et al. | 208/251 H |
| 3,317,419 | 5/1967 | Fortman | 208/251 H |
| 3,464,915 | 9/1969 | Patterson et al. | 208/211 |
| 3,617,525 | 11/1971 | Moritz et al. | 208/211 |
| 3,801,495 | 4/1974 | Gould | 208/97 |
| 3,804,748 | 4/1974 | Nelson et al. | 208/218 |
| 3,830,731 | 8/1974 | Reed, Jr. et al. | 208/218 |
| 3,876,523 | 4/1975 | Rosinski et al. | 208/89 |
| 3,876,530 | 4/1975 | Frayer et al. | 208/210 |
| 3,891,541 | 6/1975 | Oleck et al. | 208/89 |
| 3,898,155 | 8/1975 | Wilson | 208/216 |
| 3,902,991 | 9/1975 | Christensen et al. | 208/211 |
| 4,022,683 | 5/1977 | Bludis et al. | 208/92 |
| 4,062,762 | 12/1977 | Howard et al. | 208/211 |
| 4,116,816 | 9/1978 | Davis et al. | 208/218 |
| 4,191,636 | 3/1980 | Fukui et al. | 208/251 H |

*Primary Examiner*—Helane Myers

*Attorney, Agent, or Firm*—Laney, Dougherty, Hessin & Beavers

[57] ABSTRACT

A heavy crude oil is fractionated into at least three liquid fractions which include a distillate fraction boiling in the 400° F.–650° F. range and a 650° F.+ boiling range residuum. The distillate cut is hydrodesulfurized and the residuum is hydrodemetallized. The cuts thus hydrotreated, and at least a part of the third liquid fraction, are then combined to form an upgraded synthetic crude oil of relatively low sulfur content and relatively low vanadium and nickel content.

23 Claims, 1 Drawing Sheet

PROCESS FOR DEMETALLIZING AND DESULFURIZING HEAVY CRUDE OIL

BACKGROUND OF THE INVENTION

1. Field of the Invention

This invention relates to a process for removing sulfur and heavy metals from a heavy crude oil by separating the crude oil into several fractions which are selectively hydrotreated, and are then recombined to form a synthetic crude oil of improved properties.

2. Description of the Prior Art

Christensen et al U.S. Pat. No. 3,902,991 discloses a process in which a reduced crude oil is vacuum fractionated into a vacuum gas oil and a vacuum residuum fraction. The vacuum gas oil fraction is then mildly hydrotreated to reduce the sulfur content thereof, while the vacuum residuum is more severely hydrotreated to also remove sulfur therefrom. Naphtha is taken off of both the hydrodesulfurization units (the vacuum gas oil unit and the vacuum residuum unit), and by combining a fraction derived from the hydrotreated vacuum residua with the product of desulfurization of the vacuum gas oil, a low sulfur fuel oil product is yielded.

The Christensen patent does not teach hydrodemetallation of either of the treated fractions, and does not propose to start with an untopped or unreduced heavy crude oil charge stock to yield, as a final product, a syncrude stream, the properties and characteristics of which can be tailored by the way in which the hydrotreating steps are carried out, all in accordance with the teachings of the present invention.

In Moritz U.S. Pat. No. 3,617,525, an atmospheric residuum is initially fractionated by vacuum distillation into a gas oil fraction and a heavy residuum fraction. The gas oil fraction is then desulfurized by hydrotreating, and the desulfurized gas oil is then recombined with the heavy residuum. The mixture of the previously desulfurized gas oil and the heavy residuum fraction is then subjected to hydrodesulfurization. The product is desulfurized residuum having a boiling point above about 650° F.

The Moritz procedure is to be contrasted with that used in the present invention during which the heavy residuum from the initial fractionation of a heavy crude is hydrotreated to remove metals and sulfur, and in a parallel treating procedure, a distillate fraction (and optionally, a lighter naphtha fraction) is subjected (in parallel) to hydrodesulfurization. The desulfurized naphtha fraction and/or distillate fractions are then recombined with the hydrodemetallized heavy residuum to make a syncrude product.

In Gould U.S. Pat. No. 3,801,495, a procedure is disclosed in which crude oil is initially subjected to atmospheric distillation to yield atmospheric residuum and atmospheric gas oil. This gas oil is combined with gas oil produced by catalytically cracking a vacuum residuum produced upon vacuum distillation of the residuum from the atmospheric distillation. This vacuum distillation also yields a vacuum gas oil which is combined with the other gas oils. The mixture of gas oils is then subjected to hydrodesulfurization to yield a low sulfur content gas oil. The hydrogen employed for the hydrodesulfurization unit is produced by reforming methane.

There is no teaching in the Gould patent of hydrogen treating any of the heavy residuum streams, nor is there any disclosure of fractionating a crude oil charge stock into several fractions concurrently yielded by distillation, and then hydrotreating each of these fractions in parallel before recombining them to make a synthetic crude oil.

Fractionation of a sulfur-containing naphtha to provide a lower boiling fraction, an intermediate boiling fraction and a higher boiling fraction, each of which is then treated, by parallel treatment, to remove sulfur from the several fractions is taught in Howard et al U.S. Pat. No. 4,062,762. The desulfurized naphtha fractions are then combined in a blending zone. The higher boiling fraction withdrawn from the fractionator as the bottoms is subjected to hydrotreating to remove the sulfur therefrom. The intermediate fraction, however, is subjected to an alkali metal in combination with hydrogen to achieve desulfurization. The final blend which is achieved by this method is a low sulfur content naphtha.

The desulfurization procedures used in the process disclosed in the Howard et al patent for treating the intermediate and lower boiling fractions are not hydrotreating procedures as employed in the process of the present invention, and there is no teaching in the Howard et al patent of upgrading a heavy crude oil to a synthetic crude oil having customized properties.

In Bludis et al U.S. Pat. No. 4,022,683, a process is disclosed which has as its objective the hydrodenitrogenation of shale oil. The shale oil is initially fractionated into a relatively light fraction and a heavy fraction. These are then each subjected to a hydrotreating procedure in which a different catalyst is used for the hydrotreating of the light fraction as compared to the catalyst used in hydrotreating the heavy fraction. A principle objective, in the case of each hydrotreating procedure, is to remove nitrogen from the respective fraction treated, with a minimum of hydrocracking occurring. The effluent streams from each of the hydrotreating zones are blended after hydrotreating in which, the light fraction and heavy fraction are subjected to catalytic denitrogenation in the presence of hydrogen. The resultant composite stream is then fractionated to remove hydrogen sulfide, ammonia, naphtha and possibly a small amount of furnace oil as an overhead fraction.

The Bludis et al patent is silent as to any function of the hydrogen in removing sulfur from the shale oil, and there is no disclosure in this patent of the use of a heavy crude oil as the charge stock to the process, or of the development of a synthetic crude oil as the end product of the process.

In Frayer et al U.S. Pat. No. 3,876,530, a full crude oil is desulfurized in separate units. In one embodiment, a 650° F.+ residuum containing metals in an excess quantity is hydrodesulfurized in a first unit, while a lighter distillate fraction is hydrodesulfurized separately in a second unit, and thus the problem of metal contamination and high catalyst deactivation is avoided with respect to at least the second unit. Thereupon the desulfurized distillate, or a portion thereof, and the desulfurized residua can be reblended to provide a total desulfurized crude oil.

Wilson U.S. Pat. No. 3,898,155 describes a process for simultaneously demetallizing and desulfurizing a heavy oil by employing a certain catalyst composition which has a controlled distribution of micropores and macropores so as to allow the catalyst to function effectively both for metal deposition thereon, and for desulfurization.

Rosinski et al U.S. Pat. No. 3,876,523 discloses a process for removing sulfur and certain deleterious metals, such as nickel and vanadium, from a petroleum crude oil by contacting the crude oil, in the presence of hydrogen, with an alumina base catalyst incorporating a Group VI-B metal and a Group VIII metal. A hydrogen pressure of from about 500 to about 3,000 p.s.i.g. is used, and the hydrogen circulation rate employed is from 1,000 to 15,000 s.c.f./bbl. The temperature used is from about 600° F. to about 850° F. and the space velocity is from about 0.1 to about 5.0 L.H.S.V. The demetallized and desulfurized oil thus produced can then be charged to a cracking zone or to a coking zone.

SUMMARY OF THE INVENTION

The present invention is a process by which heavy crude oil can be upgraded by removing nickel and vanadium metals, and also sulfur and nitrogen heteroatoms, from the crude oil. By this upgrading procedure, a synthetic crude oil having the desirable properties of low metal content, and a low concentration of sulfur and nitrogen is achieved. The process entails initially vacuum or atmospheric fractionating a heavy crude charge stock to provide at least three liquid fractions. These typically include a naphtha cut of $C_5$—400° F. atmospheric pressure boiling range, a distillate cut having an atmospheric pressure boiling range of about 400° F. to about 650° F., and a heavy residuum from the fractionation which commences to boil at a temperature at least as high as about 650° F. The process next entails catalytically hydrodesulfurizing at least the distillate cut, and optionally the naphtha cut also, according to the properties of the heavy crude oil charge stock and the specifications established for the purpose of developing a synthetic crude oil of certain predetermined properties.

The residuum is fed to a hydrodemetallation unit where the residuum is demetallized and desulfurized over a suitable catalyst. The desulfurized-demetallized treated residuum is then recombined with the naphtha and/or distillate fractions to produce the synthetic crude oil constituting the end product. The relative amounts of distillate, naphtha and residuum, which are developed by fractionation, then treated in the manner described, and finally recombined, are determined by the properties of the synthetic crude oil which are sought. The conditions of hydrotreating the residuum and lighter fractions are also selectively varied to effect some selectivity in the properties of the syncrude product.

An important object of the invention is to provide a procedure by which heavy crude oils which contain significant concentrations of metals and have a high sulfur content can be efficiently converted to upgraded and more valuable synthetic crude oils in a relatively inexpensive fashion.

A further object of the invention is to provide an improved method for removing sulfur and metals from a crude oil charge stock.

Additional objects and advantages of the invention will become apparent as the following detailed description of a preferred embodiment of the invention is read in conjunction with reference to the accompanying drawing which illustrates such preferred embodiment.

GENERAL DESCRIPTION OF THE DRAWINGS

DETAILED DESCRIPTION OF PREFERRED EMBODIMENTS OF THE INVENTION

Figures 1, 2:
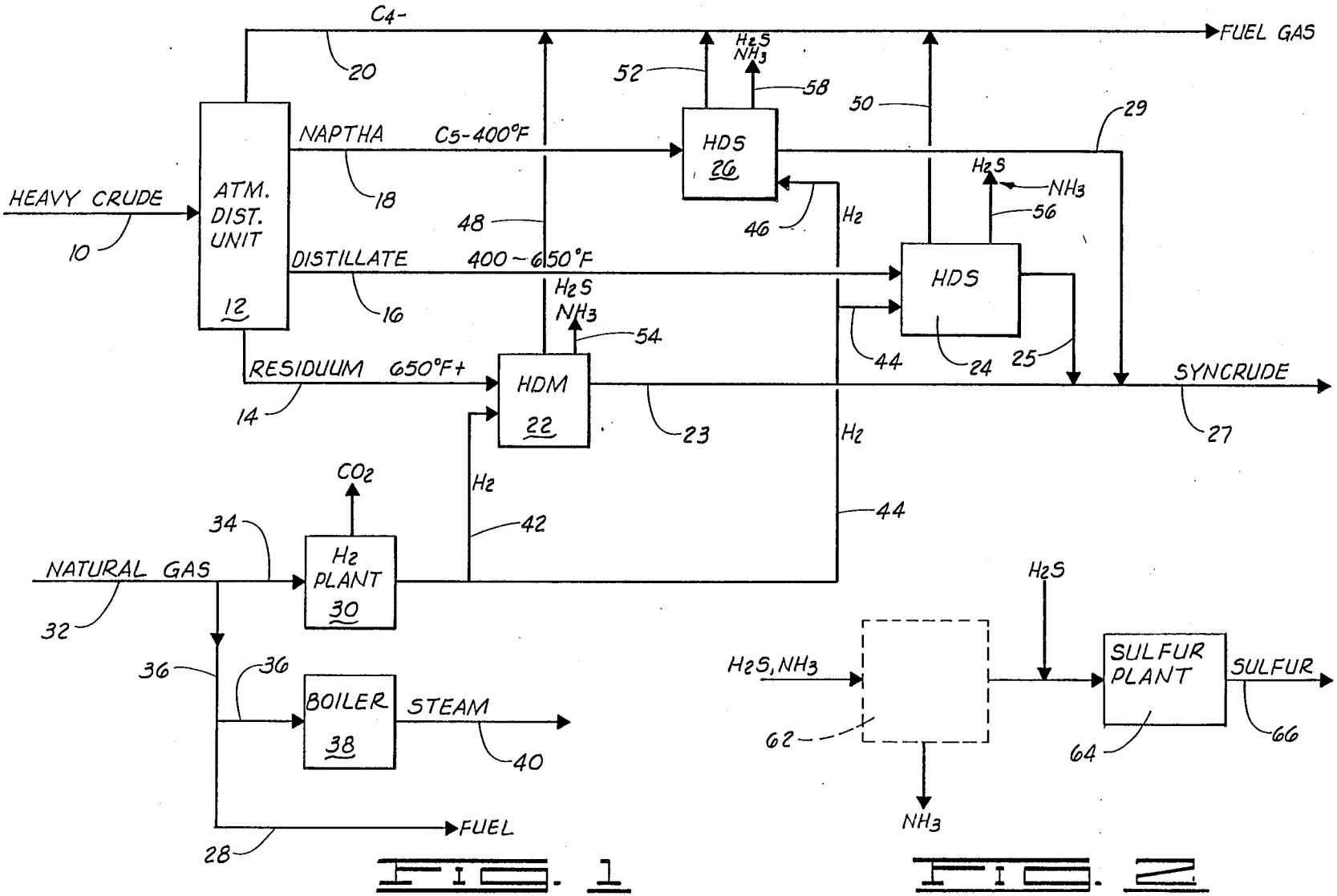
FIG. 1 is a schematic flow-diagram of a basic embodiment of the invention in which a heavy crude oil is treated in accordance with the principles of the invention to develop an upgraded, synthetic crude oil.
FIG. 2 is a schematic illustration of the manner in which sulfur and ammonia are derived as by-products of the process of the invention.

Referring now to FIG. 1, a heavy crude oil feed stock is charged via line 10 to atmospheric crude oil distillation unit 12 Heavy crude oils constituting suitable feed stocks are, in general, crude oils having an °A.P.I. gravity at 60° F. of less than 20, and a sulfur content of at least 1.0 percent. In addition, suitable heavy crude oil charge stocks will typically have a viscosity of from about 100 cp. to about 1000 cp. at reservoir temperature, a nickel and vanadium ion content of at least 200 ppm, and will contain from about 5 to about 25 weight percent of asphaltenes. Heavy crude oils of this type include, for example, certain offshore California crudes, such as Hondo crude oil, and also Boscan crude and Monagas crude.

The heavy crude is typically fed to the atmospheric distillation unit 12 at a rate of from about 75,000–200,000 barrels per operating day, (BPOD). The fractionation or distillation unit 12 is a typical atmospheric distillation unit conventionally used in the petroleum refining art. It should be here pointed out that the principles of the invention are also applicable to vacuum distillations. In the atmospheric distillation unit, the crude oil charge stock is fractionated into (a) an atmospheric residuum boiling above about 650° F. which is removed from the distillation unit in line 14, (b) a distillate fraction boiling between about 400° F. and about 650° F., and which is passed through line 16, (c) a naphtha fraction, which has a boiling range from the boiling point of $C_5$ hydrocarbons up to about 400° F., and finally, (d) an overhead gaseous fraction which has a maximum boiling point which corresponds to about the boiling point of $C_4$ hydrocarbons. The naphtha fraction is removed from the distillation unit by way of line 18, and the overhead is removed via line 20.

The atmospheric residuum flowing from the atmospheric distillation unit 12 through the line 14 passes to a hydrodemetallation reactor 22 in which the residuum is subjected to catalyzed hydrodemetallation for the purpose of removing a substantial portion of the undesirable metals therefrom, and particularly, vanadium and nickel. A substantial portion of the sulfur in the residuum is also removed. The type of catalyst utilized and the conditions employed in the hydrodemetallation reactor 22, though generally known and well understood, are subsequently discussed. The treated residuum is discharged from the reactor 22 in line 23.

The distillate fraction from the atmospheric distillation unit 12 passes through the line 16 to a hydrodesulfurization reactor 24. In the hydrodesulfurization reactor 24, substantial portions of the sulfur and nitrogen content of the distillate stream are removed by catalytic desulfurization reactions carried out in the presence of hydrogen gas, and under conditions hereinafter described. The desulfurized distillate is removed from the reactor 24 in the line 25. The naphtha fraction passes from the distillation unit 12 via the conduit 18. The naphtha stream may optionally be treated with hydrogen gas in a desulfurization reactor 26 in the presence of a suitable hydrodesulfurization catalyst to reduce its sulfur and nitrogen content. After treatment, or in the absence of treatment, the naphtha is discharged in line 29.

After carrying out demetallation and desulfurization of the residuum, and desulfurization and denitrogenation of the distillate fraction and optionally, the naphtha fraction, the naphtha and/or the distillate, both now of reduced sulfur and nitrogen content, are recombined with the demetallized residuum in line 27 to produce a synthetic crude oil which is upgraded relative to the heavy crude previously charged to the atmospheric distillation unit 12. The light gas overhead stream flowing into line 20 from the distillation unit 12 will generally be utilized primarily for fuel to provide a substantial portion of the heat input required to operate the process of the invention. Some additional make up fuel gas will be added as may be required, and can conveniently be derived from natural gas charged to the process as illustrated in FIG. 1, and is represented by the fuel gas supply derived from line 28.

It should here be pointed out that the principles of the invention can also be utilized to treat generally correlative fractions derived from an initial vacuum distillation of the heavy crude (as contrasted with atmospheric distillation).

As will have become apparent from the discussion of the invention thus far, it is necessary to provide substantial quantities of hydrogen for the purpose of operating the hydrodemetallation reactor 22, and the two hydrodesulfurization reactors 24 and 26 which are used for substantially reducing the sulfur content of the distillate stream and the naphtha stream, respectively. In a preferred method for performing the process of the present invention, a major portion of the hydrogen gas required for hydrodemetallation and hydrodesulfurization is generated in a hydrogen plant denominated by reference numeral 30. Although there are various ways of generating the hydrogen required to operate the hydrodemetallation and hydrodesulfurization reactors, including several methods in which the hydrogen is derived from steam, the preferred method for use in the present invention is a procedure in which methane or liquefied petroleum gas or naphtha is reformed by contact with steam to yield hydrogen. The most preferred method of producing the required hydrogen is by reforming methane gas, and such procedure is illustrated in FIG. 1, where natural gas is charged to the hydrogen plant 30 by way of charging lines 32 and 34. A portion of the natural gas from the line 32 is diverted through a line 36 and used (a) to fire a boiler 38 in order to develop steam used in the process and carried from the boiler in the line 40, and (b) to supply make-up or supplementary fuel gas via the line 28.

The hydrogen gas which is generated in the hydrogen plant 30 by natural gas reformation is split into two and optionally three streams. One portion of the hydrogen is directed through the line 42 to the hydrodemetallation reactor 22. Another portion of the generated hydrogen is directed through the line 44 into the hydrodesulfurization reactor 24 receiving distillate from line 16. Finally, a part of the hydrogen gas may be directed through line 46 to the hydrodesulfurization reactor 26 in which the naphtha can be treated to remove a substantial portion of the sulfur and nitrogen therefrom.

Before discussing the specific types of catalysts employed in the several reactors, and the reactor conditions obtaining therein, it may be pointed out that in each of the reactors 22, 24 and 26, relatively light fuel gases are produced in the course of the demetallation and desulfurization reactions. Thus, light ends from the demetallation reactor, and including, generally, gases boiling below $C_5$ hydrocarbons, are discharged through the line 48 and are combined with the gaseous overhead from the distillation unit 12 flowing in line 20. Similarly, the light ends or fuel gases developed in the distillate desulfurization reactor 24 are charged to the line 20 via a conduit 50, and the light ends or fuel gases from the naphtha hydrodesulfurization reactor 26 are charged to the line 20 via a conduit 52.

Also removed from each of the reactors as product gases are hydrogen sulfide and ammonia gas. The discharges of these gases from the several reactors are thus by way of line 54 in the case of the hydrodemetallation reactor 22, line 56 in the case of the hydrodesulfurization reactor 24, and line 58 in the case of the hydrodesulfurization reactor 26 when the same is utilized. The technology of separating these gases from the light ends or fuel gases is well understood in the art.

The hydrogen sulfide gas produced in the several reactors 22, 24 and 26 can be further treated by conventional processes to yield elemental sulfur. This is illustrated in FIG. 2 of the drawings, where optional ammonia recovery unit 62 is illustrated, along with a sulfur plant 64 which converts the hydrogen sulfide, produced in the several desulfurization and demetallation reactors, to elemental sulfur which is discharged via line 66.

Substantially all of the deleterious metals present in the heavy crude charge stock are carried into the atmospheric residuum or bottoms fraction, and are subjected to the hydrodemetallation treatment in the reactor 22. By reason of the concentration of the metals in the residuum moving via line 14 into the reactor 22, a significant concentration of such metals is not present in the distillate stream moving in conduit 16, or in the naphtha stream in conduit 18. Therefore, desulfurization catalyst contamination resulting from the presence of significant quantities of deleterious metals in these latter streams is substantially reduced.

In the hydrodemetallation unit 22, the residuum is passed over a stacked bed catalyst containing varying percentages of a promoted catalyst, such as GC-106 or GC-107, and a non-promoted refractory oxide catalyst, such as alumina, which will function as the support for the promoted catalyst. The optimum percentage of the promoted catalyst vis-a-vis the non-promoted catalyst varies, depending upon the particular synthetic crude oil which it is desired to produce as the end product of the process.

HYDRODEMETALLATION

Hydrogen generated in hydrogen plant 30 is directed through the line 42 to the hydrodemetallation unit 22 where it enhances the deposition of vanadium and nickel metal on the hydrodemetallation catalyst, and also facilitates a high percentage of desulfurization and denitrogenation of the residuum. In general, many types of hydrodemetallation catalysts are available and their properties are well known. A specific type of hydrodemetallation catalyst which can be utilized is a stacked bed system which comprises a Group VI-B metal, such as molybdenum, tungsten or chromium, or the compounds thereof, present as a hydrogenating component, and at least one Group VIII metal, such as iron, cobalt or nickel or a compound thereof, (also acting as a hydrogenation component), both composited upon a non-promoted refractory inorganic oxide. Alumina is a typical, suitable refractory oxide supporting substrate. Other suitable refractory oxide substrate materials include alumina, zirconia, silica, magnesia and boria and mixtures thereof. The concentration of the Group VI-B metal will preferably range from about 5 weight percent to about 40 weight percent of the total catalyst composition, and the concentration of the Group VIII metal will preferably range from about 0.1 to about 5.0 weight percent of the total catalyst composition.

The refractory inorganic oxide portion of the catalyst composition may typically have from about 10 to about 50 percent of the total pore volume in macropores, with the remainder of the pore volume being micropores. A macropore is generally defined as a pore having a diameter of greater than 500° A. units. At least 80 percent of the micropore volume is made up of pores having a diameter of at least 100° A. units. The catalyst composition further has a total pore volume of at least 0.5 ml per gram, and an average diameter greater than 100° A. units,. and a surface area of at least 110 square meters per gram. The promoter used in the promoted portion of the composite catalyst is a metal selected from the Group I, Group II and Group IV-B metals. This particular catalyst, when utilized in the hydrodemetallation unit 22 in the presence of hydrogen, is quite effective to simultaneously remove from the residuum the heavy metals, nickel and vanadium, and also a substantial part of the sulfur.

Generally molybdenum may be added to the refractory inorganic oxide of the catalytic system in the hydrodemetallation unit in order to prolong the catalyst life and prevent its early deactivation due to its exposure to the metals carried in the atmospheric residuum.

There are various commercially available demetallation catalysts, such as GC-106 and GC-107 manufactured by Gulf Oil Company of Pittsburg, Pa., and also by others.

In addition to stacked, fix bed catalyst systems, expanded bed or ebbulating-bed or slurry-type systems can be utilized for the demetallation catalyst.

The temperature in the hydrodemetallation reactor 22 typically ranges from about 600° F. to about 900° F., with from about 700° F. to about 800° F. being preferred. Hydrogen is charged to the reactor at partial pressures in the range of from 500 to 3,000 p.s.i.g., with from about 600 to about 2,500 p.s.i.g. being preferred. The hydrogen gas used is of at least 60 percent purity, and is typically circulated through the demetallation reaction zone at a rate of from about 2,000 to about 9,000 s.c.f./bbl. of feed; preferably from about 4,000 to about 8,000 s.c.f./bbl. The hydrogen flow direction can be upflow or downflow, concurrent or countercurrent. The space velocity within the demetallation unit is in the range from about 0.1 to about 5.0, and preferably is from about 0.2 to about 1.5 liquid volumes of oil per volume of catalyst per hour (LHSV).

HYDRODESULFURIZATION

In the hydrodesulfurization reactions carried out in the hydrodesulfurization reactors 24 and 26 in which the distillate, and optionally the naphtha, respectively, are treated, relatively mild hydrodesulfurization conditions are used. Under these conditions, the hydrogen partial pressure will generally be in the range of from about 250 p.s.i.g. to about 900 p.s.i.g., and preferably is in the range of from about 400 p.s.i.g. to about 700 p.s.i.g. The temperature utilized in the hydrodesulfurization units is in the range of from about 500° F. to about 850° F., and preferably is from about 700° F. to about 800° F. The liquid hourly space velocity (LHSV) is from about 2 to about 3.

A selective, high activity hydrodesulfurization catalyst can effectively be utilized in the dehydrosulfurization reactors 24 and 26, and can typically be a solid catalyst composite which includes as a first component, a Group VIII metal or metal compound (oxide or sulfide), and a second component Group VI-B metal or metal compound (oxide or sulfide) mounted upon an alumina substrate having an average pore diameter in the range of from about 65° A. to about 130° A. and a pore volume in the range of from about 0.3 cc per gram to about 1.0 cc per gram. Preferably the hydrodesulfurization catalyst used will comprise cobalt and molybdenum, or the compounds of these metals, mounted upon an alumina substrate which has an average pore diameter in the range of from about 80° A. to about 110° A. The atomic ratio of cobalt to molybdenum is in the range from about 0.3 to about 0.6, and preferably is about 0.4. The preferred catalyst has a pore volume of at least 0.5 cc per gram. Finally, the cobalt and molybdenum are preferably sulfided, either prior to use or during the operation of the process.

Although the hydrodesulfurization catalyst is generally constituted similarly to the hydrometallation catalyst, the average pore size of the substrate used in the latter will be larger than the substrate pore size of the hydrodesulfurization catalyst In either case, stacked fixed beds or ebbulating-beds or expanded beds of catalyst can be used, although the stacked fixed bed is preferred.

An effective commercially available hydrodesulfurization catalyst is sold under the name HDS-1441 by American Cyanamide Corporation. Others which are suitable include Shell 324 and Union RF-11 sold by Union Oil Company.

EXAMPLE I

In FIGS. 1 and 2 of the drawings, the process of the invention is presented by means of simplified flow diagrams. In these diagrams details as to pumps, instrumentation and controls, heat exchange and heat recovery circuits, valving, start up lines and similar structural details, have been omitted because they do not constitute the essence, or any significant aspect, of the invention, are generally off-the-shelf items and are well understood by those having ordinary skill in this technology. The use of such miscellaneous appurtenances to modify the process, or to make it more effective, are well within the purview and understanding of those skilled in the art.

For the purpose of demonstrating the illustrated preferred, basic embodiment, FIG. 1 will be described as the process there shown is used for the conversion of a Honda off-shore California heavy crude oil to an upgraded synthetic crude oil in a commercially scaled unit which has a crude oil charge stock rate of 150,000 barrels per operating day (BPOD).

The 150,000 BPOD Hondo crude oil charged to the atmospheric distillation unit 12 typically contains 4.7 weight percent sulfur, about 0.46 weight percent nitrogen and has an °A.P.I. gravity at 60° F. of 19.3. The Hondo crude oil contains about 320 ppm of nickel and vanadium metal, and has the following boiling range characteristics:

| Percent Off | B.P. (°F.) |
|---|---|
| 5.0 percent | 216 |
| 10.0 percent | 320 |
| 30.0 percent | 676 |
| 50.0 percent | 981. |

The Conradson carbon content of the Hondo crude oil is approximately 10.3 weight percent. It has a pour point of −10° F.

In the atmospheric distillation unit 12, the Hondo crude oil is separated into a residuum, distillate fraction and naphtha fraction as previously described. The atmospheric distillation yields 91,364 BPOD of the 650° F.+ residuum which contains 6.06 weight percent sulfur, 0.66 weight percent nitrogen, 13.5 weight percent RAMS carbon residue and 475 total ppm of nickel and vanadium metal. Thus, the metals become concentrated in the residuum, and the sulfur and nitrogen contents of the residuum are also substantially higher than in the unfractionated crude oil charge stock.

The distillate stream which leaves the distillation unit by line 16 is produced at the rate of 31,050 BPOD and contains 2.9 weight percent sulfur, and 0.11 weight percent nitrogen. The metals content of this stream is negligible. The naphtha stream moving from the atmospheric distillation unit in the line 18, flows at the rate of 27,286 BPOD and contains 0.87 weight percent sulfur and a negligible amount of the heavy metals nickel and vanadium, and of nitrogen containing compounds. The overhead from the distillation unit 12 consists of 300 BPOD of light gases discharged into line 20.

From the hydrogen plant 409,263 pounds of hydrogen per day is charged to the hydrodemetallation reactor 22 where it is commingled with the residuum from the atmospheric distillation unit 12 in the ratio of 850 s.c.f./bbl. The residuum is demetallized and is discharged from the hydrodemetallation unit at a rate of 95,182 barrels per day. The effluent residuum in line 23 has a metals (nickel and vanadium) content of 43 ppm and is characterized by an °A.P.I. gravity at 60° F. of 21. It contains 1.3 weight percent sulfur and 0.48 weight percent nitrogen. In the demetallation reactor 22, hydrogen sulfide is produced at the rate of 1,681,117 lbs/day and ammonia is produced at the rate of 81,083 lbs/day. Light hydrocarbon gases ($C_4$ and below) are produced in the demetallation reaction at the rate of 345,000 lbs/day.

The distillate which is charged to the hydrodesulfurization reactor 24 is commingled with hydrogen charged to this reactor at the rate of 60,545 lbs/day so that the commingled hydrogen is mixed with the distillate in the ratio of 370 s.c.f./bbl. The treated, low sulfur distillate leaves the reactor 24 at the rate of 31,364 BPOD via the line 25. This upgraded distillate stream contains 0.15 weight percent sulfur, 0.08 weight percent nitrogen and has an °A.P.I. gravity at 60° F. of 36.6. In the hydrodesulfurization reactor 24 in which the distillate stream is treated, hydrogen sulfide is generated at the rate of 276,494 lbs/day and ammonia gas is produced at the rate of 3,791 lbs/day. The light hydrocarbon gases boiling lower than pentane are generated in an amount of 955 lbs/day, and these gases are, merged with the overhead gases flowing in the line 20.

In this example, the sulfur content specification for the synthetic crude oil product is met without the need for desulfurizing the naphtha stream 18. The HDS reactor 26 is therefore bypassed.

The synthetic crude oil constituting the principal product of the process of the invention is developed by the blending of the naphtha stream from line 18, the desulfurized distillate stream from the reactor 24 and the demetallized and desulfurized residuum stream from the reactor 22. This yields 153,832 barrels per day of the synthetic crude oil, shown being removed via the line 27. This product has an °A.P.I. gravity of 29.6 and contains 1.0 weight percent sulfur and 0.3 weight percent nitrogen. It has a Ramsbottom carbon residue content of 5.1 weight percent, and a metals (vanadium and nickel) content of 28 ppm.

For the purpose of producing the hydrogen gas needed for the hydrodemetallation and the hydrodesulfurization reactions, natural gas in the amount of 23.6 MM s.c.f.d. is charged to the hydrogen plant via line 34, and 6.6 MM s.c.f.d. of natural gas is charged to the boiler 38 via line 36 for the purpose of producing 218.2 lbs/hr of steam. The remainder of the natural gas, 29.1 MM s.c.f.d., is removed in line 28 and is used to supplement the fuel gas developed in the process, and flowing in the line 20, for purposes of supplying the fuel requirements of the process of the invention.

The 1,957,611 lbs/day of hydrogen sulfide produced in the several desulfurization and demetallation reactors 22 and 24 is charged to a sulfur plant 64 and is converted into 814.2 long tons per day of sulfur. The 84,874 lbs/day of ammonia which is produced in the process is separated from the hydrogen sulfide to recover 38.2 tons/day of ammonia. This recovery procedure is illustrated in FIG. 2 of the drawings.

Although certain preferred embodiments have been herein described in order to illustrate and typify the basic principles which underlie the invention, it will be understood that various changes and innovations can be effected in the details of the described process steps, reactants and parameters without departure from such basic principles. Changes of this type are therefore deemed to be within the spirit and scope of the invention, and to be encompassed by the following claims, insofar as a fair and reasonable interpretation thereof will permit.

We claim:

1. A process for producing a synthetic crude oil of improved properties by desulfurizing, denitrogenating and demetallizing a heavy crude oil feed stock, said feed stock being a crude oil having an average boiling point at least as high as 500° F., an °API gravity at 60° F. of less than 20, and containing at least about 1 weight percent sulfur, which process comprises:

separating said heavy crude oil feed stock into four fractions including an atmospheric residuum fraction having an initial boiling point at least as high as 650° F., a distillate fraction having a boiling range of from about 400° F. to about 650° F., a naphtha fraction having a boiling range of from about that of $C_5$ hydrocarbons to about 400° F., and a light hydrocarbon gas overhead containing predominantly hydrocarbon gases;

contacting the distillate fraction with a desulfurization catalyst, and with hydrogen gas, in a first hydrodesulfurization zone under conditions of temperature, hydrogen partial pressure, hydrogen flow rate, catalytic activity and space velocity such as to remove a substantial portion of the sulfur and nitrogen from the distillate fraction;

concurrently with such contacting of the distillate fraction, contacting at least a substantial portion of said residuum fraction with hydrogen gas in the presence of a hydrodemetallation catalyst also having hydrodesulfurizing activity, in a hydrodemetallation zone under conditions of temperature, hydrogen partial pressure, hydrogen flow rate, and space velocity such that a major portion of the nickel and vanadium metal content of the residuum is removed therefrom, and a substantial potion of the sulfur content of the residuum is concurrently removed therefrom; then recombining the naphtha fraction, the hydrotreated distillate, and the hydrotreated residuum fractions to yield an improved, synthetic crude oil.

2. A process for producing a synthetic crude oil of improved properties as defined in claim 1 wherein the hydrogen gas used in the first hydrodesulfurization zone is derived from the reformation of natural gas.

3. A process for producing a synthetic crude oil of improved properties as defined in claim 1 wherein light hydrocarbon fuel gases produced in said hydrodesulfurization zone and in said hydrodemetallation zone are combined with said light hydrocarbon gas overhead.

4. A process for producing a synthetic crude oil of improved properties as defined in claim 1 wherein said conditions in said hydrodesulfurization zone include a temperature in the range of from about 550° F. to about 850° F., a hydrogen partial pressure of from about 250 p.s.i.g. to about 900 p.s.i.g., a hydrogen flow rate of from about 100 s.c.f./bbl. to about 600 s.c.f./bbl., and a space velocity of from about 2 LHSV to about 3 LHSV.

5. A process for producing a synthetic crude oil of improved properties as defined in claim 1 wherein said conditions in said hydrodemetallation zone include a temperature in the range of from about 600° F. to about 900° F., a hydrogen partial pressure of from about 500 p.s.i.g. to about 3,000 p.s.i.g., a hydrogen flow rate of from about 2,000 s.c.f./bbl. to about 9000 s.c.f./bbl., and a space velocity of from about 0.1 to about 5.0 LHSV.

6. A process for producing a synthetic crude oil of improved properties as defined in claim 1 and further characterized as including the step of contacting said naphtha fraction, prior to recombining it with the hydrotreated distillate and residuum fractions, with a desulfurization catalyst, and with hydrogen gas, in a second hydrodesulfurization zone under conditions of temperature, hydrogen partial pressure, hydrogen flow rate, catalytic activity and space velocity such as to remove a substantial portion of the sulfur and nitrogen from the naphtha fraction.

7. A process for producing a synthetic crude oil of improved properties as defined in claim 1 wherein said hydrodesulfurization catalyst comprises a refractory inorganic oxide substrate having supported thereon, a first component selected from the group consisting of Group VIII metals and Group VIII metal compounds, and a second component selected from the group consisting of Group VI-B metals and compounds of Group VI-B metals.

8. A process for producing a synthetic crude oil of improved properties as defined in claim 1 wherein said hydrodemetallation catalyst comprises a refractory inorganic oxide substrate having supported thereon, a first compound selected from the group consisting of the Group VI-B metals and the compounds of Group VI-B metals, and a second component selected from the group consisting of Group VIII metals.

9. A process for producing a synthetic crude oil of improved properties as defined in claim 1 wherein sulfur and ammonia are recovered as by-products derived from the desulfurization reactions occurring in the hydrodesulfurization zone and the hydrodemetallation zone.

10. A process for producing a synthetic crude oil of improved properties as defined in claim 4 wherein said temperature is in the range of from about 700° F. to about 800° F. and the hydrogen partial pressure is in the range of from about 400 p.s.i.g. to about 700 p.s.i.g.

11. A process for producing a synthetic crude oil of improved properties as defined in claim 5 wherein the temperature is in the range of from about 100° F. to about 800° F. and the hydrogen partial pressure is in the range of from about 600 p.s.i.g. to about 2,500 p.s.i.g., and the hydrogen flow rate is from about 4,000 s.c.f./bbl. to about 8,000 s.c.f./bbl.

12. A process for producing a synthetic crude oil of improved properties as defined in claim 7 wherein said desulfurization catalyst is further characterized in that the refractory inorganic oxide substrate comprises alumina having an average pore diameter in the range of from about 65° A. to about 130° A., and a pore volume in the range of from about 0.3 cc/gram to about 1.00 cc/gram.

13. A process for producing a synthetic crude oil of improved properties as defined in claim 5 wherein said conditions in said hydrodesulfurization zone include a temperature in the range of from about 550° F. to about 850° F., a hydrogen partial pressure of from about 250 p.s.i.g. to about 900 p.s.i.g., a hydrogen flow rate of from about 100 s.c.f./bbl. to about 600 s.c.f./bbl., and a space velocity of from about 2 LHSV to about 3 LHSV.

14. A process for producing a synthetic crude oil of improved properties as defined in claim 13 and further characterized as including the step of contacting said naphtha fraction, prior to recombining it with the hydrotreated distillate and residuum fractions, with a desulfurization catalyst, and with hydrogen gas, in a second hydrodesulfurization zone under conditions of temperature, hydrogen partial pressure, hydrogen flow rate, catalytic activity and space velocity such as to remove a substantial portion of the sulfur and nitrogen from the naphtha fraction.

15. A process for producing a synthetic crude oil of improved properties as defined in claim 13 wherein said hydrodesulfurization catalyst comprises a refractory inorganic oxide substrate having supported thereon, a first component selected from the group consisting of Group VIII metals and Group VIII metal compounds, and a second component selected from the group consisting of Group VI-B metals and compounds of Group VI-B metals.

16. A process for producing a synthetic crude oil of improved properties as defined in claim 15 wherein said hydrodemetallation catalyst comprises a refractory inorganic oxide substrate having supported thereon, a first compound selected from the group consisting of the Group VI-B metals and the compounds of Group VI-B metals, and a second component selected from the group consisting of Group VIII metals.

17. A process for upgrading a heavy crude oil having an average boiling point at least as high as 500? F., an °API gravity at 60? F. of less than 20, containing at least about 1.0 weight percent sulfur, and having a combined nickel and vanadium ion content of at least about 1,000 ppm, which process comprises:

fractionating the heavy crude oil at atmospheric pressure to yield at least three fractions which include:

an atmospheric residuum fraction having an initial boiling point at least as high as 650° F.;

a distillate fraction having a boiling range of from about 400° F. to about 650° F.;

a third fraction having a boiling range having its highest temperature at least as low as 400° F.;

contacting the residuum fraction with a hydrometallation catalyst in the presence of hydrogen under conditions of temperature, hydrogen partial pressure, hydrogen flow rate and space velocity such that major portions of the nickel, vanadium and sulfur present in the heavy crude oil are removed from the residuum fraction;

substantially concurrently with such contacting of at least a major portion of residuum fraction, contacting the distillate fraction with a hydrodesulfurization catalyst in the presence of hydrogen gas under conditions of temperature, hydrogen partial pressure, hydrogen flow rate and space velocity such as to remove a substantial portion of the sulfur and nitrogen from the distillate fraction; then recombining the hydrotreated distillate fraction and the hydrotreated residuum and a selected portion derived from the remainder of the fractionated heavy crude oil to yield a synthetic crude oil of selected characteristics.

18. A process for upgrading a heavy crude oil as defined in claim 17 wherein said hydrodemetallation catalyst comprises:

a porous refractory inorganic substrate material having supported thereon a first metal selected from the group consisting of molybdenum, tungsten and chromium and a second metal selected from the group consisting of iron, cobalt and nickel; and wherein said hydrodesulfurization catalyst comprises a porous refractory inorganic substrate material having supported thereon a first component selected from the group consisting of molybdenum, tungsten and chromium and compounds thereof, and a second component selected from the group consisting of iron, cobalt and nickel and compounds thereof.

19. A process for upgrading a heavy crude oil as defined in claim 17 wherein said three fractions further include, as said third fraction, a naphtha having an initial boiling range of from about 400° F. down to about the boiling point of normal pentane, and further characterized as including the step of desulfurizing said naphtha fraction to yield said selected portion derived from the remainder of the fractionated crude oil.

20. A process for upgrading a heavy crude oil as defined in claim 17 wherein said selected portion comprises a naphtha fraction having a boiling range of from about 400° F. down to about the boiling point of normal pentane.

21. A process for upgrading a heavy crude oil as defined in claim 17 wherein sulfur and ammonia are recovered as by-products derived from desulfurization reactions occurring in the hydrodesulfurizing zone and the hydrodemetallation zone.

22. A process for upgrading a heavy crude oil as defined in claim 19 wherein said hydrodemetallation catalyst comprises:

a porous, refractory, inorganic substrate material comprising alumina and having supported thereon a first component selected from the group consisting of molybdenum, tungsten and chromium and compounds thereof, and a second component selected from the group consisting of iron, cobalt and nickel and compounds thereof; and wherein said naphtha fraction is desulfurized by the use of a desulfurization catalyst in the presence of hydrogen gas, and said desulfurization catalyst corresponds to the desulfurization catalyst utilized in contacting the distillate fraction in the presence of hydrogen gas.

23. A process for producing a synthetic crude oil of improved properties by desulfurizing, denitrogenating and demetallizing a heavy crude oil feedstock, said feedstock being a crude oil having an average boiling point at atmospheric pressure which is at least as high as 500° F., and API gravity at 60° F. of less than 20, and containing at least about 1.0 weight percent sulfur, which process comprises:

separating the heavy crude oil feed stock into four fractions which include:

a relatively heavy residuum fraction having an initial boiling point at atmospheric pressure of at least −650° F;

a distillate fraction having a boiling range of from about 400° F. to about 650° F. at atmospheric pressure; and a relatively light naptha fraction having a higher boiling range than said distillate fraction and having a maximum boiling point of about 400° F. at atmospheric pressure; and a light hydrocarbon gas overhead containing predominantly hydrocarbon gas;

contacting the distillate fraction with a desulfurizing catalyst and with hydrogen gas in a first hydrodesulfurization zone under conditions of temperature, hydrogen partial pressure, hydrogen flow rate, catalyst activity and space velocity such as to remove a substantial portion of the sulfur and nitrogen from the distillate fraction;

contacting at least a substantial portion of said residuum fraction with hydrogen gas in the presence of a hydrodesulfurization catalyst also having hydrodesulfurizing activity, in a hydrodemetallation zone under conditions of temperature, hydrogen partial pressure, hydrogen flow rate and space velocity such that a major portion of the nickel and vanadium metal contact of the residuum is removed therefrom, and a substantial portion of the sulfur content of the residuum is concurrently removed therefrom; then recombining the naptha fraction, the hydrotreated distillate, and the hydrotreated residuum fractions to yield an improved synthetic crude oil.

* * * * *

UNITED STATES PATENT AND TRADEMARK OFFICE

CERTIFICATE OF CORRECTION

PATENT NO. : 4,885,080

DATED : December 5, 1989

INVENTOR(S) : Ronald E. Brown et al.

It is certified that error appears in the above-identified patent and that said Letters Patent is hereby corrected as shown below:

Column 11, line 12 (claim 1), change "potion" to --portion--;

Column 12, line 67 (claim 17), change "60?F." to --60°F.--;

Column 13, line 8 (claim 17), after "650°F;" insert --and--

Column 13, line 12 (claim 17), change "emetallation" to --demetallation--;

Column 14, line 24 (claim 23), after "500°F.," delete the word "and"; insert --an--.

Column 14, line 31 (claim 23), change "-650°F;" to --650°F;--;

Column 14, lines 41 and 42 (claim 23), change "desulfurizing" to --desulfurization--;

Column 14, line 50 (claim 23), change "hydrodesulfurization" to --hydrodemetallation--; and

UNITED STATES PATENT AND TRADEMARK OFFICE

CERTIFICATE OF CORRECTION

PATENT NO. : 4,885,080

DATED : December 5, 1989

INVENTOR(S) : Ronald E. Brown et al

It is certified that error appears in the above-identified patent and that said Letters Patent is hereby corrected as shown below:

Column 14, line 55 (claim 23), change "contact" to -content--.

Signed and Sealed this

Sixth Day of November, 1990

*Attest:*

HARRY F. MANBECK, JR.

*Attesting Officer*

*Commissioner of Patents and Trademarks*